United States Patent [19]

Einstabland et al.

[11] Patent Number: 4,741,648

[45] Date of Patent: May 3, 1988

[54] OFFSHORE PLATFORM STRUCTURE HAVING AT LEAST A SUPERSTRUCTURE AND A SUBSTRUCTURE MADE OF REINFORCED CONCRETE, AND SLIPFORMING MEANS FOR SLIPFORMING SUPPORTING COLUMNS OF SUCH STRUCTURE

[75] Inventors: Tomas Einstabland, Asker; Torlak Opedal, Hosle, both of Norway

[73] Assignee: Ingenior F. Selmer A/S, Oslo, Norway

[21] Appl. No.: 46,135

[22] Filed: Aug. 12, 1987

Related U.S. Application Data

[62] Division of Ser. No. 619,151, Jun. 5, 1984, Pat. No. 4,688,967.

[30] Foreign Application Priority Data

Oct. 21, 1982 [NO] Norway ..... 823503

[51] Int. Cl.[4] ..... E02D 5/40; E04G 11/22

[52] U.S. Cl. ..... 405/223; 249/48; 405/222; 405/204; 425/63

[58] Field of Search ..... 405/195, 203, 204, 222, 405/223, 205; 425/63-65; 249/10, 11, 9, 48; 264/31-35

[56] References Cited

U.S. PATENT DOCUMENTS

| | | | |
|---|---|---|---|
| 3,456,447 | 7/1969 | MacKintosh | 405/203 |
| 3,509,606 | 5/1970 | Fisher | 425/63 |
| 3,901,472 | 8/1975 | Ahlgren | 425/63 X |
| 4,002,038 | 1/1977 | Phares et al. | 405/203 X |
| 4,043,138 | 8/1977 | Stageboe et al. | 405/205 |
| 4,063,857 | 12/1977 | Thoma | 425/63 |
| 4,256,417 | 3/1981 | Bohannon | 405/203 X |

FOREIGN PATENT DOCUMENTS

| | | | |
|---|---|---|---|
| 117661 | 5/1970 | Denmark | 405/223 |
| 3125436 | 1/1983 | Fed. Rep. of Germany | 405/223 |
| 135677 | 1/1977 | Norway | 405/204 |
| 137559 | 12/1977 | Norway | 405/223 |
| 138258 | 4/1978 | Norway | 405/223 |
| 142005 | 3/1980 | Norway | 405/222 |
| 327529 | 8/1970 | Sweden | 405/223 |
| 365571 | 3/1974 | Sweden | 405/223 |
| 1512078 | 5/1978 | United Kingdom | 405/223 |
| 2085948 | 5/1982 | United Kingdom | 405/204 |

*Primary Examiner*—Dennis L. Taylor

*Attorney, Agent, or Firm*—Fleit, Jacobson, Cohn & Price

[57] ABSTRACT

Slipforming means intended for slipforming inclined, hollow columns of reinforced concrete, comprising a slipform platform (14) including the form work (28, 29), which is supported by and may be lifted/lowered by means of a climbing rod system (12) which is fixed to the already cast, cured portions of the column (11). The form work is by means of a number of yokes (26,27) suspended from the slipform platform and comprises inner and outer formsheets (28,29) extending in circumferential direction. The yokes are adjustable in radial direction with respect to the slipform platform while the form sheets are adjustable in tangential or circumferential direction with respect to each other. One of the form work walls is radially adjustable with respect to the other. The slipforming means is intended for slipforming hollow, inclined columns having increasing and/or decreasing diameter.

1 Claim, 3 Drawing Sheets

OFFSHORE PLATFORM STRUCTURE HAVING AT LEAST A SUPERSTRUCTURE AND A SUBSTRUCTURE MADE OF REINFORCED CONCRETE, AND SLIPFORMING MEANS FOR SLIPFORMING SUPPORTING COLUMNS OF SUCH STRUCTURE

This is a divisional of application Ser. No. 619,151, filed June 5, 1984, now U.S. Pat. No. 4,688,967.

The present invention relates to an offshore platform structure comprising a deck superstructure, a substructure and a base structure having in general a polygonal, preferable a triangular shape. The substructure consists of at least three lower supporting columns which are positioned apart and extend upwardly and inwardly from the base structure to an intermediate structure. The substructure consists further of one or more upper columns extending upwardly from the intermediate structure, supporting the deck superstructure. At least the base structure and the substructure are made of reinforced concrete.

The present invention relates further to means for slipforming, intended for slipforming the supporting columns as described above, comprising a slipform platform provided with slipforms which is supported by and may be lifted or lowered by means of a system of climbing rods rigidly supported by the cured portions of the previously cast column, a downwardly extending steering tower which is pivotally/rotatably fixed to the slipform platform, extending in general parallel to the previously cured portions of the column and a steering waggon fixed to the steering tower. The steering waggon is provided with roller or sliding means equally spaced in vertical and circumferential direction, said roller or sliding means being in contact with inner wall of the column and means for adjusting the inclination of the steering tower with respect to the steering waggon and consequently with respect to the previously cured portions of the column. The slipform is suspended from the slipform platform by means of a plurality of yokes and comprises an inner and outer, in general cylindrical or elliptical wall formed of form sheets arranged around the periphery of the slipform platform.

Offshore platform structures as described above are well known in the art, for instant from Norwegian Patent Specification No. 135,677. Means for slipforming inclined, hollow columns of concrete for such offshore platform structures is for instant known from Norwegian Patent Specification No. 137,559 and British Patent Specification No. 1,512,078.

Construction and towing of an offshore platform structure to the offshore location is performed with the platform structure in an upright vertical position. During the towing phase it is desirable with as large draught as possible, since such large draught from a buoyancy and stability point of view is beneficial for the design of the platform structure. From the stability point of view it is advantageous having large buoyant volumes arranged high up in the structure. The optimal towing draught would be a draught corresponding to the water depth at the offshore location less the required practical clearance between the sea bed and the structure. Due to limited water depths along the towing route the towing draught will be substantially less than the water depth at the offshore location, for locations with depths exceeding approximately 300 meters. For a platform structure, for instant intended to be installed on locations having 400 meters depths, more than half the platform structure will project above the sea level during the towing phase. If, in addition to the concrete substructure, a deck superstructure is installed on top of the columns, the stability of the entire structure will be seriously affected. Norwegian Patent Application No. 80,2268 discloses a method of improving the stability by means of incorporated secondary buoyancy tanks.

For an offshore platform structure described above, intended to be installed at locations having large waters depths, for instant 400 meters, the intermediate structure will be positioned above the towing water line during the towing phase. This implies that only the lower supporting columns provide the required buoyancy and stability.

The object of the present invention is to arrange a larger part of the buoyancy at a higher level in the structure, in order to improve the stability. The object is achieved by providing the lower supporting columns of the platform structure with varying diameter, in such way that the columns have their largest diameter in the area of the towing water line during the tow of the platform structure out to be offshore location.

By increasing the diameter of the lower supporting columns in the area of the towing water line for the towing, both the buoyancy and the stability are improved since the increase in buoyance appears in the upper portions of the lower supporting columns. As a consequence the additional advantage of obtaining supporting columns having lower ends with reduced diameter and consequently thinner wall thickness, is achieved, Such feature is of importance since the largest water pressure is of course imposed on the lower portions of the lower supporting columns.

The present invention is also improved in that the new column design provides for a large increase in top load on the deck superstructure during the towing phase.

The slipforming means of the type described above is an improvement substantially in that the yokes are arranged radially extendable on or in conjunction with the slipforming platform while the form sheets are movably arranged in tangential or circumferential direction with respect to each other, and that one of the walls of the form work is radially displaceable with respect to the other wall, thereby enabling casting of inclined, hollowing columns with increasing and/or decreasing diameter.

The present invention will now be discussed in further detail by way of examples and under reference to the drawings, wherein.

Figure 1:
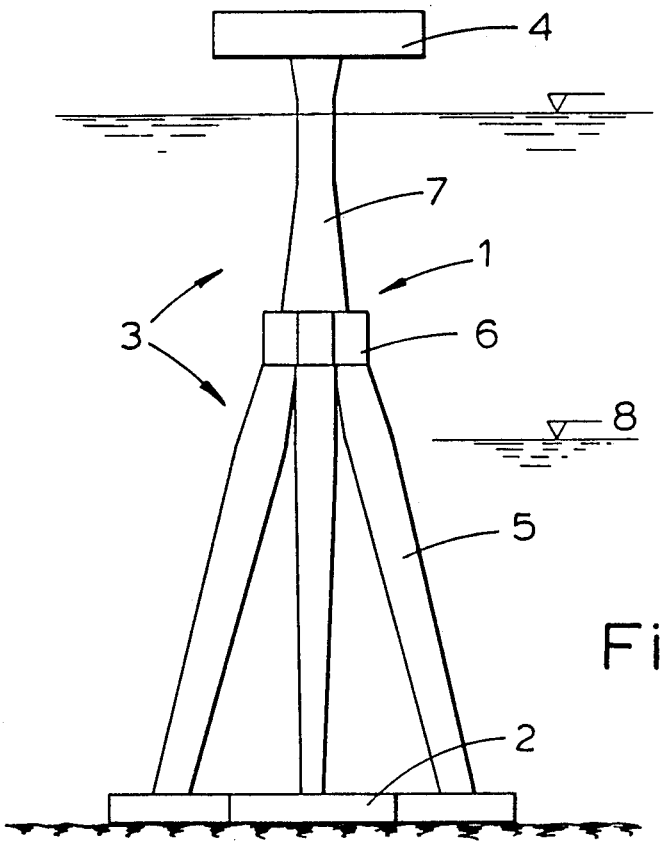
FIG. 1 shows schematically a vertical view of the platform structure according to the present invention.

FIG. 1 shows schematically an offshore platform structure 1 having a base structure 2, a substructure 3 and a deck superstructure 4. The substructure 3 comprises lower supporting columns 5 which meet in an intermediate structure 6, the intermediate structure 6 supporting one or more upper supporting columns 7, on which the deck superstructure 4 rests.

The substructure 3 is shown, having three inclined lower supporting columns 5. It should be appreciated, however, that the substructure may comprise four or more columns. Further, the upper part of the substructure is shown with only one upper supporting column 7. It is apparent, however, that the deck superstructure may be supported by for instant two upper supporting columns.

The offshore platform structure shown in FIG. 1 is designed for large water depths, such as for instant approximately 400 meters. As shown the lower supporting columns 5 are equipped with increasing cross sectional area in vertical direction. The cross sectional area increases from the base structure to a level 8°, whereafter the cross sectional area again decreases towards the intermediate structure 6. The portion 8 of the supporting columns 5 having the largest diameter is arranged approximately the level which corresponds to the towing water line for towing of the platform structure from the construction site to the offshore location. The increase of the diameter of the hollow inclined column 5 results in an increase of the hollow, inner volume of the upper portions of the column, thereby moving the centre of buoyance of the platform structure upwards (when compared with a corresponding platform structure where the lower, inclined columns have a constant diameter). The offshore structure shown in FIG. 1 is consequently designed for an offshore location having a water depth of approximately 400 meters and where the minimum towing depth en route may be approximately 250 meters.

Figure 2:
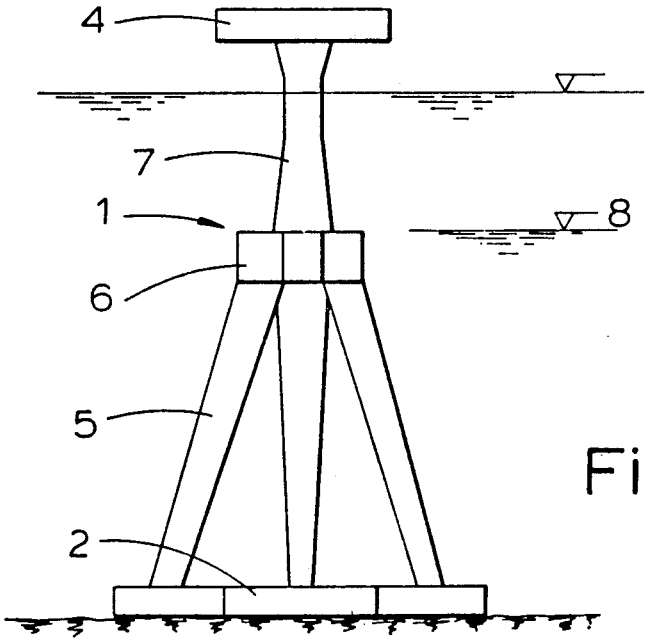
FIG. 2 shows a second embodiment of the platform structure.

FIG. 2 shows a platform structure of the same type as shown in FIG. 1, the platform structure being, however, designed for more shallow waters, such as for instant approximately 300 meters, while the towing draught during the towing phase being as for the platform structure shown in FIG. 1, is for instant 330 meters. The various parts of the platform structure shown in FIG. 2 are identified with the same reference numerals as for the platform structure shown in FIG. 1, the main differences being that the lower supporting columns 5 have their largest diameter at the top, i.e. at the level where the columns are fixed to the intermediate structure 6. The latter structure will, due to its inner volume, add to the increase in buoyancy. The towing water line is placed approximately at the top of the intermediate structure 6.

Figure 3:
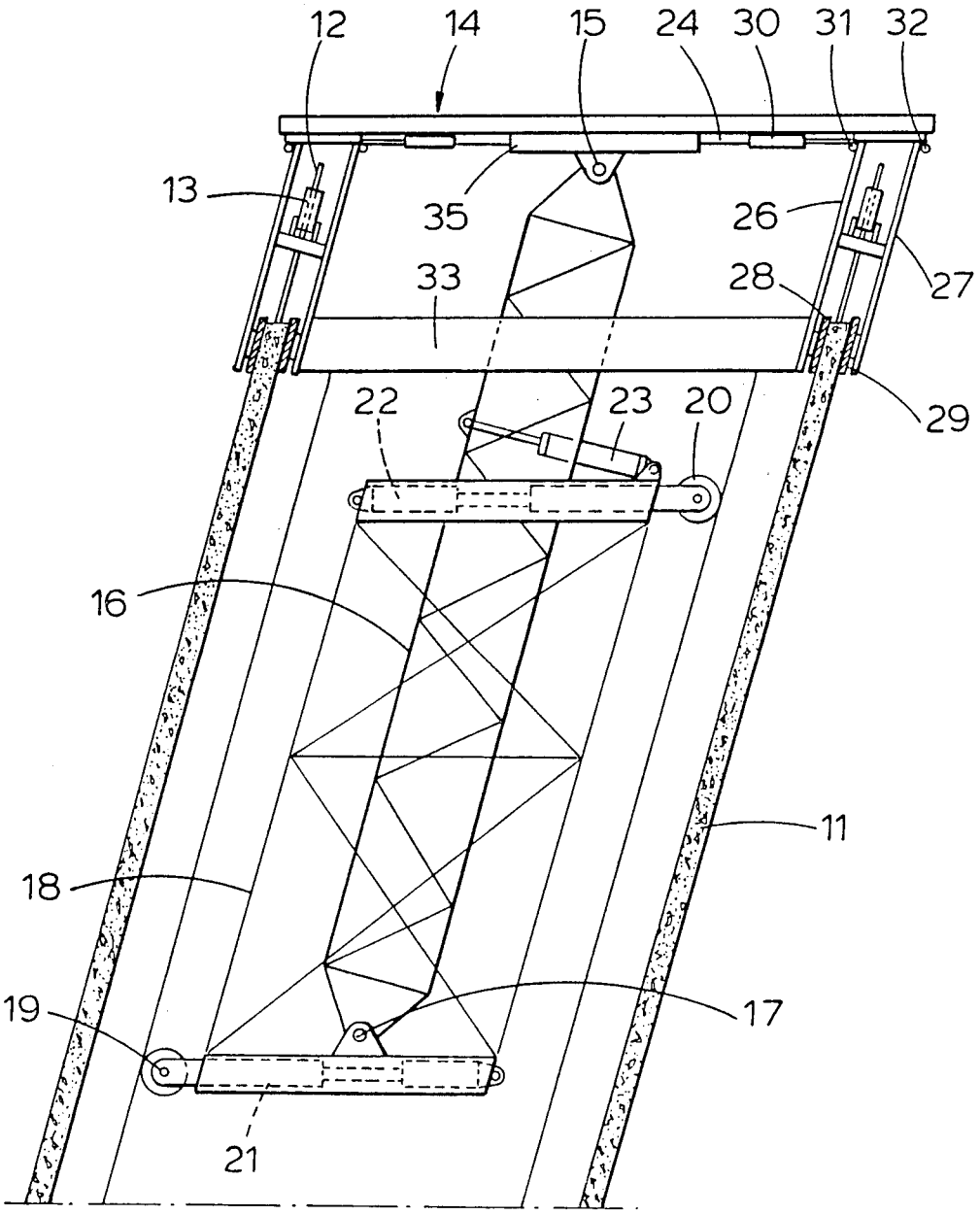
FIG. 3 shows a vertical section through the upper portion of an inclined column during slipforming by means of the slipforming means according to the present invention, said slipforming means being arranged on top of the cured part of the column, and the section going through a diameter of the column.

FIG. 3 shows schematically a vertical section through the centre portion of the upper part of an inclined column, slipformed with upwardly increasing diameter. A slipforming means according to the present invention is supported by said upper part of the casted inclined column.

The column is hollow and is formed of reinforced concrete. The column wall is indicated by means of the reference numeral 11. Around the periphery of the top of the column wall 11, a plurality of evenly distributed climbing rods 12 are cast into the column wall 11, onto which rods 12 climbing jacks 13 supporting the slipforming platform 14 are mounted. By means of the jacks 13 the platform 14 may be lifted or lowered with respect to the cured portion of the column.

A steering tower 16 is suspended from the approximately middle area of the platform 14 by means of a pivot. At its lower end the steering tower 16 is provided with a pivot 17 for supporting a steering waggon 18. The steering waggon 18 is equipped with a pair of lower steering wheels which are in a forced engagement with the column wall in a direction away from the direction of indication and a pair of upper diametrically opposite steering wheels 20 which are in forced contact with the column wall in the direction of the inclination. The wheels 19,20 may be extended in direction towards/away from the column wall by means of hydraulic jacks 21,22. The hydraulic jacks 23 are placed between the upper part of the steering waggon 18 and the steering tower 16 and serves as means for changing the inclination of the tower 16 with respect to the vertical in the vertical plane which extends through the centre of the platform and the column. The pivot 15 may be formed as a universal-link.

As previously pointed out, the climbing jacks 13, which may climb up or down the climbing rods 12, support the slipforming platform 14. The direction of the slipform may be monitored by means of the steering tower 16 and the steering waggon 18, these structures extending down into the slipformed, cured portion of the column. The slipforming platform 14 is formed as metal sheet and truss structure having a central place disc 35 which supports a number of radially extending beams 24 which are interconnected by diagonal stiffeners 25. At the end of each beam yokes 26,27 which support the inner respective outer slipform sheets 28,29, the yokes being supported by the climbing jacks 13.

The yokes 26,27 are arranged radially extendable on the supporting beams 24, which radial movement is achieved by means of hydraulic jacks 30 arranged on said beams. The yokes 26,27 are rotatably arranged with respect to the supporting beams 24 by means of pivots 31,32.

Figure 4:
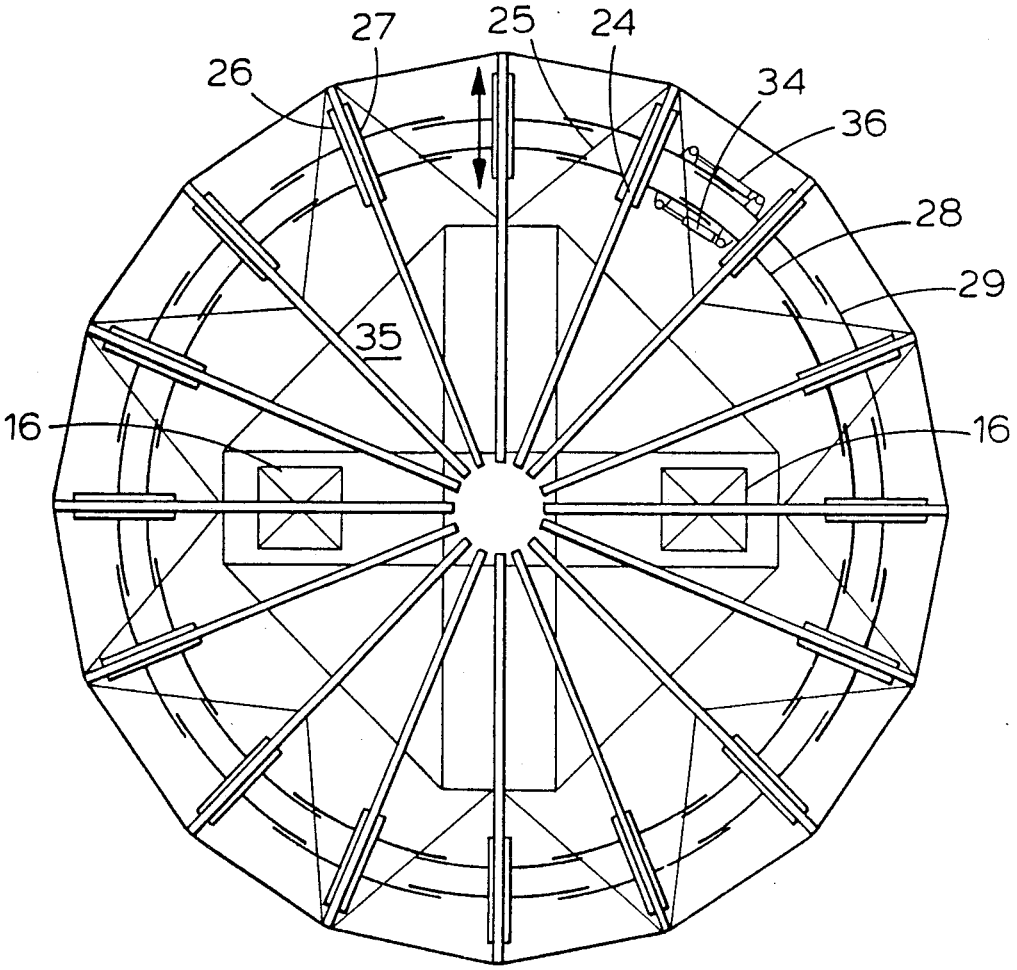
FIG. 4 shows a horizontal top view of the slipforming means shown in FIG. 3.

The formwork itself comprises a plurality of form sheets 28,29 of steel which are movable with respect to each other in circumferential direction (crf. FIG. 4). At a distance below the slipform platform 14, a working platform 33 is suspended from said slipform platform.

When slipforming is in progress and the diameter of the column is to be varied, for instant shall be increased, the hydraulic jacks 30 are caused to be moved outwardly thereby causing the yokes 26,27 to move outwardly, forcing the form sheets 28,29 outwardly as well. At the same time the form sheets also move relative to each other in circumferential direction, thereby increasing the diameter. The increase in diameter is larger at the upper end of the slipform and negligible at the lower end of the slipform where the slipform to a certain extent tends to "swing" outwardly with the casted portion of the column as a pivot. If the diameter of the column is to be reduced, the jacks 30 are moved radially towards the centre. If the angle of inclination of the columns at the same time shall be adjusted, the hydraulic jacks 23 in the steering tower 16 is actuated.

As shown in FIG. 4 tangentially arranged jacks (of which only two 34,36 are shown) are arranged between the beams 24 adjacent the form sheets. Said jacks may force two adjacent plates 28 towards or away from each other in circumferential direction. If the plates 28 are pulled towards each other, the circumferential distance of the inner form will decrease together with the inner diameter, whereby the wall thickness of the column will increase. If the jacks 34 are actuated in opposite direction the circumferential distance of the inner form will increase, thereby reducing the thickness of the column wall correspondingly. The slipforming means provides thus a possibility of slipforming inclined supporting columns having varying diameter and varying wall thickness. The slipforming means is of a type where substantially all functional systems and all monitoring and operating systems are arranged internally with respect to the form work and also with respect to the columns. The operation, maintenance and casting work are consequently simpler and easier to perform.

We claim:

1. Slipforming means intended for slipforming of inclined hollow columns of reinforced concrete, comprising a slipform platform including a slipform which is supported by and may be lifted or lowered by means of a climbing rod system which are cast into the cured portion of the column, a downwardly projecting steering tower which is rotatably/pivotably suspended from the slipform platform and which is arranged in general parallel with the lastly cured portion of the column, and a steering waggon suspended from the steering tower, the steering waggon being provided with wheels or sliding element distributed in spaced relation both with respect to the vertical axis and the circumference, said wheels or sliding elements being in forced contact with the inner wall of the column, and means for varying the inclination of the steering tower with respect to the steering waggon and consequently the cured portions of the column wall, and where the slipform work by means of a plurality of yokes is suspended from the slipform platform, the form work comprising an inner and outer, substantially circular or elliptical wall consisting of in circumferential direction arranged form sheets, characterized in that the yokes are adjustably arranged in radial direction on the slipform platform and that the form sheets are adjustably arranged in tangential or circumferential direction with respect to each other and that one of the slipform sheet walls is radially adjustable with respect to the other, thereby enabling slipforming of inclined, hollow columns having increasing and/or decreasing diameter.

* * * * *